US005866531A

United States Patent [19]

Assmann et al.

[11] Patent Number: 5,866,531

[45] Date of Patent: Feb. 2, 1999

[54] PROCESS FOR THE PRODUCTION OF DETERGENT OR CLEANING TABLETS

[75] Inventors: Georg Assmann, Juechen; Hans-Friedrich Kruse, Korschenbroich; Jochen Jacobs, Wuppertal; Volker Bauer, Duesseldorf; Guenther Vogt, Toenisvorst; Heinz-Manfred Wilsberg, Duesseldorf; Sandra Witt, Langenfeld, all of Germany

[73] Assignee: Henkel Kommanditgesellschaft auf Aktien, Duesseldorf, Germany

[21] Appl. No.: 793,021

[22] PCT Filed: Aug. 10, 1995

[86] PCT No.: PCT/EP95/03169

§ 371 Date: Mar. 26, 1997

§ 102(e) Date: Mar. 26, 1997

[87] PCT Pub. No.: WO96/06156

PCT Pub. Date: Feb. 29, 1996

[30] Foreign Application Priority Data

Aug. 19, 1994 [DE] Germany ..... 44 29 550.2

[51] Int. Cl.[6] ..... C11D 11/00

[52] U.S. Cl. ..... 510/446; 510/349; 510/351; 510/352; 510/356; 510/441; 510/466; 510/495; 510/498; 34/259; 204/157.43; 159/DIG. 26

[58] Field of Search ..... 510/446, 495, 510/498, 466, 349, 351, 352, 356, 441; 34/259; 204/157.15, 157.43; 159/DIG. 26

[56] References Cited

U.S. PATENT DOCUMENTS

| | | | |
|---|---|---|---|
| 2,894,912 | 7/1959 | Geitz | 510/153 |
| 3,366,570 | 1/1968 | Slob | 510/298 |
| 3,933,672 | 1/1976 | Bartolotta et al. | 510/438 |
| 4,118,333 | 10/1978 | Dugan et al. | 252/135 |
| 4,664,839 | 5/1987 | Rieck | 252/175 |
| 4,816,553 | 3/1989 | Baur et al. | 528/245 |
| 4,820,439 | 4/1989 | Rieck | 252/135 |
| 4,867,899 | 9/1989 | Ahmed et al. | 510/153 |
| 4,885,108 | 12/1989 | Richter | 510/447 |
| 5,318,733 | 6/1994 | Carduck et al. | 264/15 |
| 5,382,377 | 1/1995 | Raehse et al. | 252/174 |
| 5,501,814 | 3/1996 | Engelskirchen et al. | 252/174.17 |
| 5,516,447 | 5/1996 | Bauer et al. | 252/89.1 |
| 5,541,316 | 7/1996 | Engelskirchen et al. | 510/471 |
| 5,567,389 | 10/1996 | Birbara et al. | 422/28 |
| 5,660,821 | 8/1997 | Birbara et al. | 424/76.7 |

FOREIGN PATENT DOCUMENTS

| | | |
|---|---|---|
| 0 164 514 | 12/1985 | European Pat. Off. . |
| 0 280 223 | 8/1988 | European Pat. Off. . |
| 0 339 996 | 11/1989 | European Pat. Off. . |
| 0 420 317 | 4/1991 | European Pat. Off. . |
| 0 525 239 | 2/1993 | European Pat. Off. . |
| 23 27 956 | 12/1974 | Germany . |
| 31 04 371 | 11/1982 | Germany . |
| 42 21 381 | 2/1994 | Germany . |
| 43 00 772 | 7/1994 | Germany . |
| 43 19 578 | 12/1994 | Germany . |
| 44 06 210 | 8/1995 | Germany . |
| 58/217 598 | 12/1983 | Japan . |
| 90/13533 | 11/1990 | WIPO . |
| 91/02047 | 2/1991 | WIPO . |
| 91/09009 | 6/1991 | WIPO . |
| 93/04162 | 3/1993 | WIPO . |
| 93/08251 | 4/1993 | WIPO . |
| 93/16110 | 8/1993 | WIPO . |
| 93/23523 | 11/1993 | WIPO . |
| 94/25563 | 11/1994 | WIPO . |
| 96/06157 | 2/1996 | WIPO . |
| 97/26317 | 7/1997 | WIPO . |

*Primary Examiner*—Paul Lieberman
*Assistant Examiner*—Lorna M. Douyon
*Attorney, Agent, or Firm*—Ernest G. Szoke; Wayne C. Jaeschke; Real J. Grandmaison

[57] ABSTRACT

A process for producing detergent tablets containing more than 10% by weight of anionic surfactant wherein the detergent tablets contain detergent components which are at least partly in hydrated form and the anionic surfactant is present in the form of one or more compounds containing up to 95% by weight of surfactants, by exposing a mixture of the detergent components and the anionic surfactant to microwaves in the frequency range from 3 to 300,000 MHz.

11 Claims, No Drawings

PROCESS FOR THE PRODUCTION OF DETERGENT OR CLEANING TABLETS

BACKGROUND OF THE INVENTION

1. Field of the Invention

This invention relates to a process for the production of surfactant-containing detergent or cleaning tablets using microwaves.

The disadvantage of conventional detergent or cleaning tablets, particularly detergent tablets, which are normally produced by compression molding was that these tablets did not dissolve sufficiently quickly on account of their compactness and the active substances were released too slowly in the wash cycle. In addition, detergent tablets in particular had an inadequate disintegration rate.

2. Discussion of Related Art

Earlier hitherto unpublished International patent application PCT/EP94/01330, to the disclosure of which reference is specifically made, describes in detail the production of washing- and cleaning-active tablets with an extremely high dissolving or disintegration rate using microwaves. A crucial requirement for the production of tablets from powder-form or granular raw materials using microwaves is that these starting materials should be at least partly present in hydrated form, "hydrated" meaning "hydrated under certain conditions in regard to the temperature, pressure or relative humidity of the atmosphere to which the raw material is exposed or with which the raw material is in equilibrium". By "microwaves" in the context of the invention is meant the entire frequency range from 3 to 300,000 MHz which covers not only the actual microwave range above 300 MHz, but also the radio wave range from 3 to 300 MHz. So-called macrosolids, including for example blocks in addition to tablets, which may normally contain up to 40% by weight of surfactants can be produced by this technique. If one of the raw materials used in substantial quantities is a crystalline layer silicate, more particularly of the SKS-6® type (crystalline sodium disilicate, a product of Hoechst AG, Germany), the surfactant content may even be as high as 60% by weight. Other possible ingredients are, on the one hand, the microwave-active hydrated inorganic or organic salts, such as alkali metal phosphate, alkali metal carbonate, alkali metal bicarbonate, alkali metal sulfate and citrate, and also zeolite and even peroxy bleaching agents, such as perborate or percarbonate. These are preferably used in encapsulated form.

Difficulties are still involved in the production of microwave tablets containing anionic surfactants in substantial quantities, for example in quantities above 10% by weight, and inorganic salts in quantities below 60% by weight. Although tablets such as these can be produced on an industrial scale in accordance with the teaching of PCT/EP94/01330, sulfate- and sulfonate-containing anionic surfactants in particular tend to turn brown in color in concentrations as high as these so that, although washing performance is not affected, the discoloration is not accepted by the consumer. In addition, the dissolving behavior of the tablets deteriorates with increasing surfactant content.

It has now been found that the dissolving behavior of surfactant-containing microwave tablets can be increased providing a significant proportion of the surfactants is not incorporated in the tablets as an individual raw material.

DESCRIPTION OF THE INVENTION

Accordingly, the present invention relates to a process for the production of detergent or cleaning tablets containing anionic surfactants, characterized in that the tablets are produced using microwaves and in that the anionic surfactants are introduced into the process in the form of one or more compounds.

The use of such surfactant compounds, including highly concentrated surfactant compounds with contents of up to about 95% by weight of surfactants, leads to local differences in the concentration of surfactants in the tablet which has an advantageous effect not only during processing, but also during the subsequent disintegration of the tablet in the wash liquid.

The anionic surfactants used are, for example, those of the sulfonate and sulfate types. Preferred surfactants of the sulfonate type are $C_{9-13}$ alkyl benzene sulfonates, olefin sulfonates, i.e. mixtures of alkene and hydroxyalkane sulfonates and disulfonates which are obtained, for example, from $C_{12-18}$ monoolefins with a terminal or internal double bond by sulfonation with gaseous sulfur trioxide and subsequent alkaline or acidic hydrolysis of the sulfonation products. Other suitable anionic surfactants are alkane sulfonates which are obtained from $C_{12-18}$ alkanes, for example by sulfochlorination or sulfoxidation and subsequent hydrolysis or neutralization. The esters of α-sulfofatty acids (ester sulfonates), for example the α-sulfonated methyl esters of hydrogenated coconut oil, palm kernel oil or tallow fatty acids, are also suitable anionic surfactants.

Other suitable anionic surfactants are sulfonated fatty acid glycerol esters. Fatty acid glycerol esters in the context of the invention are understood to be the mono-, di- and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid. If fats and oils, i.e. natural mixtures of different fatty acid glycerol esters, are used as starting materials, they have to be substantially saturated with hydrogen in known manner before sulfonation, i.e. hydrogenated to iodine values below 5 and advantageously below 2. Typical examples of suitable starting materials are palm oil, palm kernel oil, palm stearin, olive oil, rapeseed oil, coriander oil, sunflower oil, cottonseed oil, peanut oil, linseed oil, lard oil or lard. However, it has proved to be of particular advantage to use coconut oil, palm kernel oil or beef tallow as starting material by virtue of their high natural content of saturated fatty acids. The sulfonation of the saturated fatty acids containing 6 to 22 carbon atoms or the mixtures of fatty acid glycerol esters with iodine values below 5, which contain $C_{6-22}$ fatty acids, is preferably carried out by reaction with gaseous sulfur trioxide and subsequent neutralization with aqueous bases, as described in International patent application WO-A-91/09009. The sulfonation products are a complex mixture which contains mono-, di- and triglyceride sulfonates with a sulfonic acid group in the α-position and/or an internal sulfonic acid group. Sulfonated fatty acid salts, glyceride sulfates, glycerol sulfates, glycerol and soaps are formed as secondary products. If saturated fatty acids or hydrogenated fatty acid glycerol ester mixtures are used as starting material for the sulfonation, the percentage content of α-sulfonated fatty acid disalts may easily be as high as about 60% by weight, depending on how the process is carried out.

Suitable surfactants of the sulfate type are the sulfuric acid monoesters of primary alcohols of natural and synthetic origin. Preferred alk(en)yl sulfates are the alkali metal salts and especially the sodium salts of sulfuric acid semiesters of $C_{12-18}$ fatty alcohols, for example coconut fatty alcohol, tallow fatty alcohol, lauryl, myristyl, cetyl or stearyl alcohol, or the $C_{10-20}$ oxoalcohols and the semiesters of secondary alcohols with the same chain length. Other preferred alk(en)yl sulfates are those with the chain length mentioned which contain a synthetic linear alkyl group based on petrochemicals which are comparable in their degradation behavior to the corresponding compounds based on oleochemical raw materials. $C_{16-18}$ alk(en)yl sulfates are particularly preferred from the point of view of washing performance. It can also be of particular advantage, especially for machine detergents, to use $C_{16-18}$ alk(en)yl sulfates in combination with low melting anionic surfactants and, more particularly, with anionic surfactants which have a relatively low Krafft point and which show only a slight tendency to crystallize at relatively low washing temperatures, for example from room temperature to 40° C. In one preferred embodiment of the invention, therefore, the detergents contain mixtures of short-chain and long-chain fatty alkyl sulfates, preferably $C_{12-18}$ fatty alkyl sulfates or mixtures of $C_{12-14}$ fatty alkyl sulfates or $C_{12-18}$ fatty alkyl sulfates with $C_{16-18}$ fatty alkyl sulfates and, more particularly, $C_{12-16}$ fatty alkyl sulfates with $C_{16-18}$ fatty alkyl sulfates. In another preferred embodiment of the invention, however, unsaturated alkenyl sulfates with an alkenyl chain length of, preferably, $C_{16}$ to $C_{22}$ are used in addition to saturated alkyl sulfates. Particular preference is attributed in this regard to mixtures of saturated sulfonated fatty alcohols consisting predominantly of $C_{16}$ and unsaturated sulfonated fatty alcohols consisting predominantly of $C_{18}$, for example those derived from solid or liquid fatty alcohol mixtures of the HD-Ocenol® type (a product of Henkel KGaA). Ratios by weight of alkyl sulfates to alkenyl sulfates of 10:1 to 1:2 are preferred, ratios by weight of about 5:1 to 1:1 being particularly preferred.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming power, they are used in detergents in only relatively small quantities, for example in quantities of 1 to 5% by weight.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more preferably, ethoxylated fatty alcohols. Preferred sulfosuccinates contain $C_{8-18}$ fatty alcohol residues or mixtures thereof. Particularly preferred sulfosuccinates contain a fatty alcohol residue derived from ethoxylated fatty alcohols which, for their part, are nonionic surfactants (for a description, see below). Among these sulfosuccinates, those of which the fatty alcohol residues are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut fatty acid, palm kernel fatty acid or tallow fatty acid. Soap mixtures of which 50 to 100% by weight consist of saturated $C_{12-24}$ fatty acid soaps and 0 to 50% by weight of oleic acid soap are particularly preferred.

The anionic surfactants and soaps may be present in the form of their sodium, potassium or ammonium salts and as soluble salts of organic bases, such as mono-, di- or triethanolamine. The anionic surfactants are preferably present in the form of their sodium or potassium salts, more particularly in the form of their sodium salts.

In addition to anionic surfactants, nonionic, cationic, zwitterionic or amphoteric surfactants may be used in the tablets and, optionally, even in the anionic-surfactant-containing compounds. Nonionic surfactants are particularly preferred.

The nonionic surfactants used are preferably alkoxylated, advantageously ethoxylated, more especially primary alcohols containing preferably 8 to 18 carbon atoms and, on average, 1 to 12 moles of ethylene oxide (EO) per mole of alcohol, in which the alcohol radical may be linear or preferably 2-methyl-branched or may contain linear and methyl-branched radicals in the form of the mixtures typically present in oxoalcohol radicals. However, alcohol ethoxylates containing linear $C_{12-18}$ alcohol radicals of native origin, for example coconut, palm kernel, tallow or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a special product, may be a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

Other suitable nonionic surfactants are alkyl glycosides corresponding to the general formula $RO(G)_x$, in which R is a primary, linear or methyl-branched, more especially 2-methyl-branched, aliphatic radical containing 8 to 22 carbon atoms and preferably 12 to 18 carbon atoms and G stands for a glycose unit containing 5 or 6 carbon atoms, preferably glucose. The degree of oligomerization x, which indicates the distribution of monoglycosides and oligoglycosides, is a number of 1 to 10, preferred values for x being 1.2 to 1.4.

Another class of preferred nonionic surfactants, which are used either as sole nonionic surfactant or in combination with other nonionic surfactants, are alkoxylated, preferably ethoxylated or ethoxylated and propoxylated, fatty acid alkyl esters, preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533.

Nonionic surfactants of the amine oxide type, for example N-cocoalkyl-N,N-dimethyl amine oxide and N-tallow alkyl-N,N-dihydroxyethyl amine oxide, and the fatty acid alkanolamide type are also suitable. The quantity in which these nonionic surfactants are used is preferably no more than the quantity in which the ethoxylated fatty alcohols are used and, more preferably, is no more than half that quantity.

Other suitable surfactants are polyhydroxyfatty acid amides corresponding to formula (I):

$$R^2-CO-\overset{\overset{\displaystyle R^3}{|}}{N}-[Z] \quad (I)$$

in which $R^2CO$ is an aliphatic acyl group containing 6 to 22 carbon atoms, $R^3$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

One preferred embodiment of the invention is characterized by the use of anionic-surfactant-containing compounds which contain different anionic surfactants—for example alkyl sulfates and alkyl benzene sulfonates and/or soap or alkyl sulfates and sulfonated fatty acid glycerol esters—and/or anionic surfactants in combination with nonionic surfactants—for example alkyl sulfates and ethoxylated fatty alcohols or alkyl sulfates, alkyl benzene sulfonates, ethoxylated fatty alcohols and/or alkyl glycosides or alkyl sulfates, soap, ethoxylated fatty alcohols and glucamides. The compounds in question are preferably compounds containing anionic and nonionic surfactants in a ratio by weight of 10:1 to 1:1.

Preferred compounds have a surfactant content of at least 10% by weight. Another preferred embodiment of the invention is characterized by the use of compounds containing at least 40% by weight and preferably 60 to 95% by weight, based on the compound, of anionic surfactants.

In another preferred embodiment of the invention, compounds of at least two different types are used in the process. For example, anionic surfactants and nonionic surfactants may be separated from one another in space to a very considerable extent, i.e. may be accommodated in different compounds. Compounds which contain nonionic surfactants, but no anionic surfactants, may contain for example 40 to 70% by weight of the nonionic surfactants mentioned and also known silicates and organic builders, such as polymeric polycarboxylates and/or phosphonates.

In particularly advantageous embodiments of the invention, at least 35% by weight, preferably at least 50% by weight and more preferably at least 70% by weight of the overall formulation of the detergent or cleaning tablet consists of one or more different compounds. In one particularly advantageous process, at least 70% by weight and up to 100% by weight of the overall formulation may be initially introduced as an optionally aftertreated compound.

In this way, conventional and commercially available detergents or cleaning products in which at least one compound containing anionic surfactants is present may be converted into tablets by the process according to the invention. Examples of such detergents or cleaning products are spray-dried detergents with apparent densities of around 300 to 600 g/l which preferably contain 5 to 40% by weight of anionic surfactants in the spray-dried components. These spray-dried granules may even be subsequently sprayed or "powdered" with other ingredients of detergents or cleaners under granulated conditions so that their apparent density is increased. Preferred liquid ingredients are nonionic surfactants while preferred powdering agents are, for example, fine-particle zeolites, silicas, sulfates and/or calcium stearates. In other preferred detergents or cleaners, spray-dried granules containing anionic surfactants are present alongside spray-dried or granulated compounds which consist of carrier materials, such as zeolite, crystalline layer silicates, polymeric polycarboxylates, carbonates and, optionally, even silicates and which are impregnated with liquid to paste-like or wax-like ingredients, such as nonionic surfactants and/or foam inhibitors or conventional fabric softeners.

In another embodiment, the present invention relates not only to spray-dried detergents or cleaning formulations, but also to granulated or extruded detergents or cleaning formulations which are produced, for example, by the processes according to European patent applications EP-A-0 339 996, EP-A-0 420 317 or International patent applications WO-A-93/23523 or WO-A-91/02047.

It is of course also possible and even preferred in the context of the present invention not only to convert already present formulations of the type in question into tablet form in the described manner, but also to mix separately prepared compounds optionally with relatively small quantities of individual components and to convert the resulting mixture into tablet form using microwaves. Thus, spray-dried granules containing anionic surfactants can be tabletted together with zeolite-containing granules sprayed with nonionic surfactants and/or together with individual extrudates, for example extrudates containing enzymes or bleach activators or even peroxy bleaching agents, by the microwave technique. It is also possible to use various forms of extrudates, for example those produced by the process according to earlier German patent application P 44 06 210.9, for microwave tabletting. The compounds used may also be of the type produced by drying with super-heated steam or microwaves.

In one preferred embodiment of the invention, however, compounds with high anionic surfactant contents of above 40% by weight and preferably up to 90% by weight or higher, which are produced in particular by granulation and simultaneous drying, advantageously by the fluidized bed process described in International patent application WO 93/04162, are used at least as one of several compounds.

If the compound-containing mixtures mentioned above are exposed to microwaves in accordance with International patent application PCT/EP94/01330, the compounds are fused together at the points of contact as a result of local melting/sintering. The voids present between the individual compounds before the exposure to microwaves ensure that the tablet formed is highly porous and thus contribute towards improving the dissolving properties of the tablet.

To ensure that local sintering of the compounds is possible in the first place, at least some of them must have sintering properties at their surfaces. To this end, the compounds themselves or their surfaces must contain sufficient water so that the compounds melt at their points of contact when the water is heated. According to the teaching of International patent application PCT/EP94/01330, at least part of the mixture to be exposed to microwaves must be present in hydrated form, "hydrated" meaning "hydrated under certain conditions in regard to the temperature, pressure or relative humidity of the atmosphere to which the raw material is exposed or with which the raw material is in equilibrium".

Accordingly, one embodiment of the invention is characterized by the use of compounds partly containing starting materials present in hydrated form. If these water-containing components are not present in the compounds in a quantity sufficient for sintering, if at all, the compounds may be completely or partly encapsulated with these substances in sufficient quantities before microwave tabletting. Particularly preferred encapsulating substances are amorphous silicates, such as metasilicates or waterglasses, alkali metal carbonates and alkali metal sulfates, zeolites, such as zeolite A, X, Y or P, more particularly zeolite A and P or mixtures thereof, but also organic components, such as water-containing citrates, for example sodium citrate dihydrate, or water-containing acetates, for example sodium acetate trihydrate. These encapsulating substances are advantageously introduced into the process in quantities of 1 to 30% by weight, based on the formulation as a whole.

The formulation as a whole consisting of the individual compounds and optionally other individual non-surface-active raw materials, which need not be present in compound form, is introduced into a mold and exposed to microwaves in accordance with PCT/EP94/01330. The microwave treatment leads to elevated temperatures and to local sintering of the compounds at the points of contact, the voids remaining intact in the molding, i.e. complete fusion of the compounds to one another is avoided. Accordingly, the compounds themselves do not have to withstand relatively high temperatures. This method of sintering results in a surprisingly high breaking strength of the tablet so that it can be handled and, in particular, transported without any problems.

If, nevertheless, this process should produce tablets lacking sufficient stability in strength, even in dependence upon the formulation, this problem may have arisen from the fact that the filling density of the mold was not high enough, i.e. the compounds did not have a sufficient number of mutual contact points through normal filling of the mold. In this case, assistance can be provided by a process in which the filled mold is subjected to light precompression before the microwave treatment. Any (pre)compression process known to the expert is suitable for this purpose. The precompressions are preferably carried out under pressures of 0.1 to 5 bar and, more particularly, 0.1 to 2 bar, corresponding respectively to 1–50 $N/cm^2$ and 1–20 $N/m^2$. Sufficiently large contact points between the individual compounds in the tablet are obtained in this way.

In another preferred embodiment of the invention, disintegrating agents are incorporated in the tablets, causing them to break up after coming into contact with water. Typical disintegrating agents which are preferably used in this process are, for example, citric acid or citrates, bicarbonates and carbonates, bisulfate and also percarbonate. By virtue of the relatively low temperatures occurring in this process, peroxy bleaching agents, such as perborate and even percarbonate, may be incorporated in the tablets. Other preferred disintegrating agents are microcrystalline cellulose, sugars, more particularly sorbitol, and layer silicates, more especially fine-particle and swellable layer silicates of the bentonite or smectite type. Disintegrating agents of the described type may be used in quantities of 0.5 to 30% by weight and preferably in quantities of 1 to 25% by weight, based on the formulation as a whole. The disintegrating agents may be used either as an individual raw material or again in the form of a compound.

If the residual moisture content of the overall mixture to be used should exceed around 5 to 10% by weight, it is advisable to protect the disintegrating agents against this moisture. Accordingly, one preferred embodiment of the invention is characterized by the use of disintegrating agents which are encapsulated before use with known hydrophobic components. Paraffin oil or silicone oil—which is also preferably used—are mentioned purely by way of example as encapsulating substances at this juncture.

As described in earlier application PCT/EP94/01330, the tablets may be aftertreated with other substances, preferably ingredients of detergents or cleaning products, more particularly ingredients which are sensitive to microwaves. Enzymes and perfumes are particularly mentioned in this regard. However, it may be regarded as particularly advantageous that, by virtue of the better possible temperature control or rather the relatively low exposure of the mixture as a whole to high temperatures, enzymes can also be included in the microwave treatment in the process according to the invention and no longer have to be subsequently added.

The tablets may contain any typical ingredients of detergents or cleaning products in their overall formulation. Besides the surfactants already described in detail, these ingredients include in particular inorganic and organic builders, components which prevent resoiling of fabrics (soil repellents) and redeposition inhibitors, alkaline salts, bleaching agents and bleach activators, foam inhibitors, fabric softeners, neutral salts and dyes and fragrances.

Besides the conventional phosphates, suitable inorganic builders are, in particular, alumosilicates of the zeolite type. The finely crystalline, synthetic zeolite containing bound water preferably used is detergent-quality zeolite NaA. However, zeolite X and zeolite P and mixtures of A, X and/or P are also suitable.

Suitable substitutes or partial substitutes for phosphates and zeolites are crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Corresponding crystalline layer silicates are described, for example, in European patent application EP-A-0 164 514. Preferred crystalline layer silicates are those in which M stands for sodium and x assumes the value 2 or 3. Both β- and δ-sodium disilicates $Na_2Si_2O_5.yH_2O$ are particularly preferred.

Useful organic builders are, for example, the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), providing their use is ecologically safe, and mixtures thereof. Preferred salts are the salts of polycarboxylic acids, such as citric acid, adipic acid, succinic acid, glutaric acid, tartaric acid, sugar acids and mixtures thereof.

Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and those of acrylic acid or methacrylic acid with maleic acid. Copolymers of acrylic acid with maleic acid which contain 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Biodegradable terpolymers, for example those containing salts of acrylic acid and maleic acid and also vinyl alcohol or vinyl alcohol derivatives as monomers (P 43 00 772.5) or salts of acrylic acid and 2-alkyl allyl sulfonic acid and sugar derivatives as monomers (DE 42 21 381), are also particularly referred.

Other suitable builder systems are oxidation products of carboxyfunctional polyglucosans and/or water-soluble salts thereof which are described, for example, in International patent application WO-A-93/08251 or of which the production is described, for example, in International patent application WO-A-93/16110.

The known polyaspartic acids and salts and derivatives thereof are also mentioned as preferred builders.

Other suitable builders are polyacetals which may be obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

The inorganic and/or organic builders are preferably used in the tablets in quantities of around 10 to 60% by weight and, more particularly, 15 to 50% by weight.

In addition, the detergents/cleaners may also contain components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and, in particular, methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. They are active in only small quantities. Accordingly, their content is preferably from 0.2 to 10% by weight and, more preferably, up to 5% by weight.

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight, based on the detergent.

Other suitable ingredients of the detergents/cleaning products are water-soluble inorganic salts, such as bicarbonates, carbonates, amorphous silicates or mixtures thereof. Alkali metal carbonate and amorphous alkali metal silicate, above all sodium silicate with a molar $Na_2O$ to $SiO_2$ ratio of 1:1 to 1:4.5 and preferably 1:2 to 1:3.5, are particularly preferred. The sodium carbonate content of the detergents/cleaning products is preferably up to 20% by weight and advantageously between 5 and 15% by weight. The sodium silicate content of the detergents/cleaning products is generally up to 10% by weight and preferably between 2 and 8% by weight.

The term "amorphous" in the context of the invention also encompasses "X-ray amorphous". This means that, in X-ray diffraction experiments, the silicates do not produce any of the sharp X-ray reflexes which are typical of crystalline substances, but instead only one or more maxima of the scattered X-rays which have a width of several degrees of the diffraction angle. However, it is highly possible and may even lead to particularly favorable builder properties that, in electron diffraction experiments, the silicate particles produce intergrown or even sharp diffraction maxima. This may be interpreted to mean that the products have microcrystalline regions ranging from 10 to a few hundred nm in size.

These X-ray amorphous silicates—like some commercially available compounds of carbonates and amorphous silicates—are suitable for partly or completely replacing conventional builders, such as phosphate, zeolite and crystalline layer silicates. If such substances are used, their content may even exceed the quantities mentioned above for carbonates and amorphous silicates. Contents of up to 40% by weight or even 60% by weight are entirely within the scope of the invention.

According to the teaching of earlier German patent application P 43 19 578.4, alkali metal carbonates may also be replaced by sulfur-free $C_{2-11}$ amino acids optionally containing another carboxyl and/or amino group and/or salts thereof. According to the invention, the alkali metal carbonates are preferably replaced partly or completely by glycine or glycinate.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid or diperdodecanedioic acid. The content of bleaching agents in the tablets is preferably 5 to 25% by weight and, more preferably, 10 to 20% by weight, perborate monohydrate and/or percarbonate advantageously being used.

In order to obtain an improved bleaching effect where washing is carried out at temperatures of 60° C. or lower, bleach activators may be incorporated in the preparations. Examples of bleach activators are N-acyl or O-acyl compounds which form organic peracids with $H_2O_2$, preferably N,N'-tetraacylated diamines, p-(alkanoyloxy)-benzene sulfonate, also carboxylic anhydrides and esters of polyols, such as glucose pentaacetate. Other known bleach activators are the acetylated mixtures of sorbitol and mannitol which are described, for example, in European patent application EP-A-0 525 239. The content of bleach activators in the bleach-containing tablets is in the usual range, preferably between 1 and 10% by weight and, more preferably, between 3 and 8% by weight. Particularly preferred bleach activators are N,N,N',N'-tetraacetyl ethylenediamine (TAED), 1,5-diacetyl-2,4-dioxohexahydro-1,3,5-triazine (DADHT) and acetylated sorbitol/mannitol mixtures (SORMAN).

Where the detergents are used in machine washing processes, it can be of advantage to add typical foam inhibitors to them. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, more particularly silicone- or paraffin-containing foam inhibitors, are preferably fixed to a granular water-soluble or water-dispersible support. Mixtures of paraffins and bis-stearyl ethylenediamides are particularly preferred.

Preferred salts of polyphosphonic acids are the neutrally reacting sodium salts of, for example, 1-hydroxyethane-1, 1-diphosphonate, diethylenetriamine pentamethylene phosphonate or ethylenediamine tetramethylene phosphonate which are used in quantities of 0.1 to 1.5% by weight.

Suitable enzymes are those from the class of proteases, lipases, amylases, cellulases and mixtures thereof. Enzymes obtained from bacterial strains or fungi, such as Bacillus subtilis, Bacillus licheniformis and Streptomyces griseus, are particularly suitable. Proteases of the subtilisin type are preferably used, proteases obtained from Bacillus lentus being particularly suitable. Enzyme mixtures, for example mixtures of protease and amylase or protease and lipase or protease and cellulase or mixtures of cellulase and lipase or mixtures of protease, amylase and lipase or protease, lipase and cellulase, but especially cellulase-containing mixtures, are of particular interest. Peroxidases or oxidases have also proved to be suitable in some cases. The enzymes may be adsorbed to supports and/or encapsulated in shell-forming substances to protect them against premature decomposition. The percentage content of enzymes, enzyme mixtures or enzyme granules may be, for example, of the order of 0.1 to 5% by weight and is preferably from 0.1 to around 2% by weight.

The tablets or compounds may contain derivatives of diaminostilbene disulfonic acid or alkali metal salts thereof as optical brighteners. Suitable optical brighteners are, for example, salts, of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,'-bis-(4-chloro-3-sulfostyryl)-diphenyl or 4-(4-chlorostyryl)4'-(2-sulfostyryl)-diphenyl, may also be present. Mixtures of the brighteners mentioned above may also be used.

In one preferred embodiment of the invention, tablets are produced which contain 15 to 40% by weight, preferably 18 to 35% by weight and more preferably 20 to 30% by weight of anionic or anionic and nonionic surfactants, the anionic surfactant content preferably being above 10% by weight and the ratio by weight of anionic surfactants to nonionic surfactants being 5:1 to 1:2. Particularly preferred anionic surfactants are alkyl benzene sulfonates and alkyl sulfates and also soaps. Preferred nonionic surfactants are ethoxylated $C_{12-18}$ fatty alcohols or oxoalcohols and alkyl glycosides. In addition, preferred tablets contain 10 to 60% by weight, preferably 15 to 50% by weight and more preferably 20 to 40% by weight of such builders as zeolite A and/or zeolite P, crystalline layer silicates of the SKS-6® type or amorphous or X-ray amorphous silicates and also carbonate/silicate compounds with a correspondingly high calcium binding capacity.

In another preferred embodiment of the present invention, tablets are produced which contain 40 to 60% by weight of compounds of which 10 to 90% by weight consist of anionic surfactants, advantageously alkyl benzene sulfonates and/or alkyl sulfates, and 10 to 90% by weight of builders, hydrated salts and/or disintegrating agents.

Other advantageous tablets additionally contain compounds which are free from anionic surfactants and contain builders, advantageously zeolite A and/or zeolite P, and 10 to 40% by weight of nonionic surfactants.

EXAMPLES

Example 1

A tablet was produced from the compounds, powders and liquids mentioned below in accordance with the teaching of International patent application PCT/EP94/01330. To this end, a homogeneous mixture was prepared from the components in a mixer, subsequently introduced into a mold and precompressed for 10 seconds under a pressure of 13 N/cm$^2$ (the force applied to the circular surface measured 35N over an area of 2.7 cm$^2$). The tablet was then microwaved at 2,450 MHz/700 watts. The treatment lasted 7 seconds. A temperature of 60° C. was not exceeded during the microwave treatment.

Composition:

- 3% by weight of anionic surfactant compound (consisting of 90.5% by weight of $C_{12-18}$ alkyl sulfate, 5% by weight of sodium sulfate, rest water)
- 41% by weight of spray-dried granules (consisting of 10% by weight of sodium dodecyl benzene sulfonate, 3% by weight of $C_{12-18}$ sodium fatty acid soap, 1.5% by weight of tallow fatty alcohol containing 5 ethylene oxide groups, 60% by weight of zeolite (expressed as water-free active substance), 5% by weight of sodium carbonate, 2.5% by weight of sulfate and other salts from solutions and raw materials and 18% by weight of water)
- 3% by weight of a granular foam inhibitor based on silicone oil (15% by weight)
- 14% by weight of sodium perborate monohydrate
- 7% by weight of a granular bleach activator based on tetraacetyl ethylene-diamine
- 1% by weight of sodium carbonate (calcined soda)
- 1% by weight of silica
- 2% by weight of zeolite powder
- 1% by weight of copolymeric salt of acrylic acid and maleic acid
- 3% by weight of a 30% aqueous solution of this copolymer
- 11% by weight of sodium hydrogen carbonate
- 9% by weight of citric acid
- 1% by weight of protease-based enzyme granules
- 2% by weight of $C_{12-18}$ alcohol containing 7 ethylene oxide groups
- 1% by weight of perfume The tablet had a high breaking strength under pressures of 7.4 to 37 N/cm$^2$.

The tablet also had a high disintegration rate in water. Large parts of the tablet had disintegrated after only 1 minute, 100% of the tablet having disintegrated after 5 minutes.

Percarbonate may be used instead of the perborate. In addition, the soap may be used in the form of separate soap granules containing more than 80% by weight of soap and, in addition, soda and polymeric polycarboxylates.

Example 2

A tablet was produced from the compounds, powders and liquids mentioned below in accordance with the teaching of International patent application PCT/EP94/01330. To this end, a homogeneous mixture was prepared from the components in a mixer, subsequently introduced into a mold and precompressed for 10 seconds under a pressure of 2.6 N/cm$^2$ (the force applied to the circular surface measured 7N over an area of 2.6 cm$^2$). The tablet was then microwaved at 2,450 MHz/700 watts. The treatment lasted 7 seconds. A temperature of 65° C. was not exceeded during the microwave treatment.

Composition:

3% by weight of anionic surfactant compound (consisting of 90.5% by weight of $C_{12-18}$ alkyl sulfate, 5% by weight of sodium sulfate, rest water)

48% by weight of spray-dried granules (consisting of 10.3% by weight of sodium dodecyl benzene sulfonate, 2.9% by weight of $C_{12-18}$ sodium fatty acid soap, 1.5% by weight of tallow fatty alcohol containing 5 ethylene oxide groups, 56.4% by weight of zeolite (expressed as water-free active substance), 3.4% by weight of sodium carbonate, 2.3% by weight of polyvinyl pyrrolidone, 5.4% by weight of copolymeric salt of acrylic acid and maleic acid, 1% by weight of other salts from solutions and raw materials and 16.8% by weight of water)

3% by weight of a granular foam inhibitor based on silicone oil (15% by weight)

3% by weight of sodium carbonate (calcined soda)

1% by weight of silica

3% by weight of zeolite powder

2% by weight of copolymeric salt of acrylic acid and maleic acid

11% by weight of sodium hydrogen carbonate

14% by weight of sodium citrate

1% by weight of protease-based enzyme granules

5% by weight of $C_{12-18}$ alcohol containing 7 ethylene oxide groups

1% by weight of perfume

5% by weight of sodium silicate ($Na_2O:SO_2$, 1:2.0, containing 18% by weight of water)

The tablet had a high breaking strength under pressures of 7.4 to 22 $N/cm^2$.

In addition, the tablet had a high disintegration rate in water. Large parts of the tablet had disintegrated after only 0.5 minutes, 100% of the tablet having disintegrated after 4 minutes.

We claim:

1. A process for producing detergent tablets containing more than 10% by weight of anionic surfactant wherein said detergent tablets contain detergent components which are at least partly in hydrated form and said anionic surfactant is present as a mixture of different anionic surfactants consisting essentially of exposing a mixture of said detergent components and said anionic surfactant to microwaves in the frequency range from 3 to 300,000 MHZ wherein said detergent components and said anionic surfactants are encapsulated with a hydrated material prior to exposing said mixture to microwaves, said hydrated material is selected from the group consisting of amorphous alkali metal silicates, alkali metal carbonates and bicarbonates, alkali metal sulfates and bisulfates, zeolite, citrates and acetates.

2. A process as in claim 1 wherein said detergent tablets further contain a nonionic surfactant.

3. A process as in claim 2 wherein said nonionic surfactant is selected from the group consisting of an ethoxylated primary alcohol containing 8 to 18 carbon atoms and 1 to 12 moles of ethylene oxide per mole of alcohol, alkyl glycosides, alkoxylated fatty acid alkyl esters, amine oxides, and polyhydroxy fatty acid amides.

4. A process as in claim 1 wherein said detergent tablets contain at least 35% by weight of said anionic surfactant, based on the weight of said detergent tablets.

5. A process as in claim 1 wherein said hydrated material is present in an amount of 1% to 30% by weight, based on the weight of said detergent tablets.

6. A process as in claim 1 wherein prior to exposing said mixture to microwaves, said process further consists essentially of the step of subjecting said mixture to compression.

7. A process as in claim 1 which further consists essentially of adding to said mixture of said detergent components and said anionic surfactant a tablet disintegrating agent in an amount of 0.5% to 30% by weight, based on the weight of said detergent tablets.

8. A process as in claim 7 wherein said disintegrating agent is encapsulated with a hydrophobic material selected from the group consisting of paraffin oils and silicone oils.

9. A process as in claim 1 wherein said anionic surfactant is selected from the group consisting of sulfonates, sulfates, sulfonated fatty acid glycerol esters, sulfuric acid monoesters of primary alcohols and ethoxylated derivatives thereof, salts of alkyl sulfosuccinic acid, and soap.

10. A process as in claim 1 wherein said detergent components consist essentially of inorganic or organic builders.

11. A process as in claim 10 wherein said builders are present in an amount of 10% to 60% by weight, based on the weight of said detergent tablets.

* * * * *